US006570341B2

(12) United States Patent
Padilla

(10) Patent No.: US 6,570,341 B2
(45) Date of Patent: May 27, 2003

(54) ELECTROMAGNETIC BALLAST FOR SERIALLY CONNECTED GASEOUS DISCHARGE LAMPS

(75) Inventor: Luis Alfonso Padilla, Crystal Lake, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/912,469

(22) Filed: Jul. 25, 2001

(65) Prior Publication Data

US 2002/0047618 A1 Apr. 25, 2002

Related U.S. Application Data

(60) Provisional application No. 60/221,401, filed on Jul. 28, 2000.

(51) Int. Cl.[7] ..... H05B 37/00
(52) U.S. Cl. ..... 315/177; 315/183
(58) Field of Search ..... 315/177, 183, 315/189, 250, 254, 257, 276, 278, 99

(56) References Cited

U.S. PATENT DOCUMENTS

| | | | | | |
|---|---|---|---|---|---|
| 2,446,152 | A | | 7/1948 | Alford | 315/276 |
| 3,295,015 | A | | 12/1966 | Rosiak | 315/239 |
| 3,931,543 | A | * | 1/1976 | Nuckolls | 315/177 |
| 4,101,806 | A | * | 7/1978 | Alley | 315/86 |
| 4,185,233 | A | * | 1/1980 | Riesland et al. | 315/276 |
| 4,517,498 | A | * | 5/1985 | Crawford | 315/323 |

* cited by examiner

*Primary Examiner*—Hoang Nguyen

(57) ABSTRACT

Apparatus for sequentially igniting and serially operating a pair of high output rapid start fluorescent lamps from a source of AC voltage. The apparatus includes a transformer with a primary winding that may be subdivided in two sections, a principal secondary winding connected in series aiding with one section of the primary and in opposition with the other primary section. This arrangement provides the advantage of developing a comparatively high open circuit voltage for starting the lamps without exceeding lamp holder voltage ratings.

12 Claims, 2 Drawing Sheets

ELECTROMAGNETIC BALLAST FOR SERIALLY CONNECTED GASEOUS DISCHARGE LAMPS

RELATED APPLICATIONS

This application claims the benefit of U.S. Provisional Application No. 60/221,401, filed Jul. 28, 2000.

BACKGROUND OF THE INVENTION

1. Field of the Invention

This invention relates to electromagnetic ballasts for gaseous discharge lamps and particularly to such ballasts for starting and operating serially connected fluorescent lamps.

2. Description of Related Art

The voltages which a ballast must provide to start and operate serially connected gaseous discharge lamps, e.g. fluorescent lamps, are substantially larger than those needed for single or parallel connected lamps. These voltages become even larger for higher wattage lamps and/or for lamps which must start and operate at low ambient temperatures. As a consequence, the lamp voltages might exceed the voltage ratings of fixtures and/or hardware for holding the lamps.

SUMMARY OF THE INVENTION

It is an object of the invention to provide an electromagnetic ballast which is capable of starting and operating serially connected gaseous discharge lamps at open circuit lamp voltages which exceed the rated voltages of lamp holder apparatus, but without imposing such high voltages on the lamp holder apparatus itself.

In accordance with the invention an electromagnetic ballast for starting and operating a plurality of gaseous discharge lamps, which are serially connected between a first lamp holder connection and a second lamp holder connection, comprises a transformer including a primary winding for electrical connection to an AC power source and a secondary winding. The primary winding includes first and second subwindings. The first subwinding has a first end for electrical connection to the first lamp holder connection and to the AC power source and has a second end. The second subwinding has a first end electrically connected to the second end of the first subwinding and has a second end for electrical connection to the AC power source. The secondary winding has a first end electrically connected to the second end of the first subwinding and to the first end of the second subwinding and has a second end electrically connected to the second lamp holder connection. The windings are wound such that, in operation, voltages produced by the first subwinding and the secondary winding are additive, but voltages produced by the second subwinding and the secondary winding are subtractive, whereby the voltage at each of the lamp connections is substantially lower than the voltage across the serially connected lamps.

DESCRIPTION OF THE PREFERRED EMBODIMENT

Figure 1:
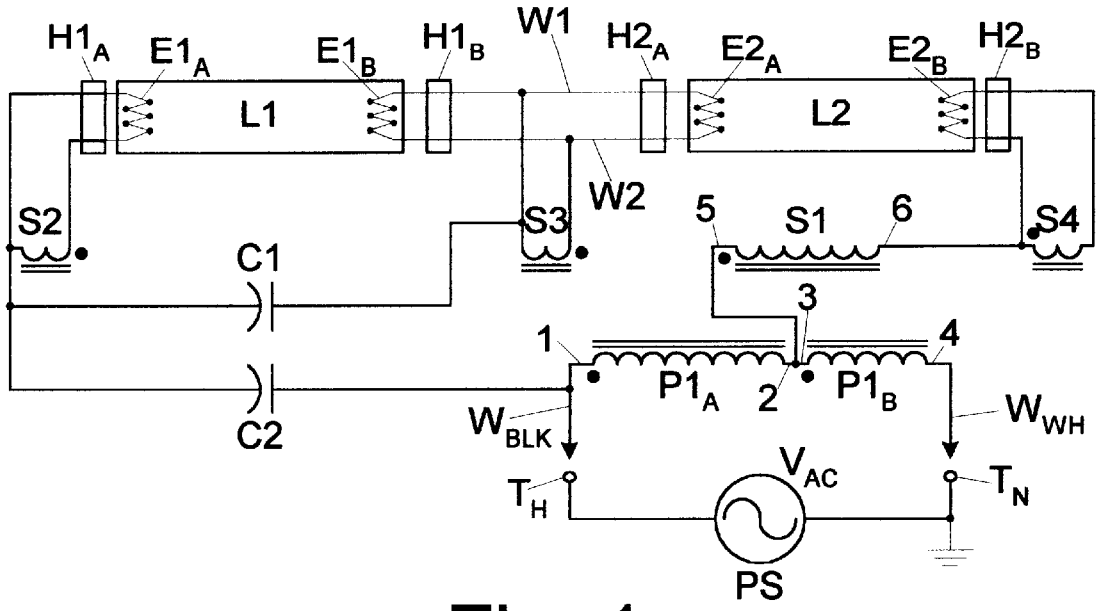
FIG. 1 is a schematic illustration of a first embodiment of an electromagnetic ballast for powering serially connected fluorescent lamps.

FIG. 1 schematically illustrates an exemplary embodiment of an electromagnetic ballast for starting and operating serially connected fluorescent lamps L1 and L2. Lamp L1 includes filamentary electrodes $E1_A$ and $E1_B$ positioned within opposite ends of the lamp envelope. Two pairs of conductive pins, which are electrically connected to opposite ends of the electrodes $E1_A$ and $E1_B$, extend through the envelope and are received within respective lamp holders $H1_A$ and $H1_B$. Similarly, lamp L2 includes filamentary electrodes $E2_A$ and $E2_B$ positioned within opposite ends of the lamp envelope and electrically connected to respective pairs of lamp pins which extend through the envelope and are received within respective lamp holders $H2_A$ and $H2_B$. Each of the lamp holders is a conventional socket which includes a pair of electrical contacts for making electrical connections to the ends of a respective one of the filamentary electrodes via the conductive pins received in the lamp holder.

The lamps L1 and L2 are electrically connected in series combination by conductors W1 and W2, each of which is connected to respective one end of each of the lamp electrodes $E1_B$ and $E2_A$ via the electrical contacts in lamp holders $H1_B$ and $H2_A$. A capacitor C1 is electrically connected in parallel with lamp U for the purpose of shunting this lamp during starting, so that all of the available open circuit voltage is applied initially across lamp L2. Once the lamp L2 starts its impedance drops and the available voltage is now applied across the lamp L1 causing it to start.

The ballast includes a transformer having a primary winding and a plurality of secondary windings, all wound on a common magnetic core, as is well known in the art. The primary winding includes a first sub winding, $P1_A$ having ends 1 and 2, and a second sub winding $P1_B$, having ends 3 and 4. The ends 2 and 3 are commonly electrically connected to form an intermediate tap of the primary winding. A principal secondary winding S1 has one end 5 electrically connected to the tap of the primary winding. Secondary windings S2, S3 and S4 are provided for applying relatively low heating voltages to the filamentary electrodes. Winding S2 is electrically connected to electrode $E1_A$ via lamp holder $H1_A$, winding S3 is electrically connected to electrodes $E1_B$ and $E2_A$ via wires W1, W2 and lamp holders $H1_B$, $H2_A$, and winding S4 is electrically connected to electrode $E2_B$ via lamp holder $H2_B$.

Note that each of the windings has a dot symbol near one end to indicate the polarity of the voltage across the winding. Thus, for example, whenever the voltage at the dot end of any winding is positive with respect to the voltage at the other end, the same is true at all other windings.

In order to apply starting and operating power to the lamps, the primary winding and the principal secondary winding are electrically connected to a source of AC power PS and to the series combination of the lamps L1 and L2. However, this is done in a manner which avoids applying the full open circuit starting or operating voltage (relative to ground) to any of the lamp connections. Specifically:

End 1 of the primary winding is electrically connected to the electrode $E1_A$ at one end of the series combination, via a power factor correction capacitor C2 and the lamp holder $H1_A$, and also to the power source PS, via a lead $W_{BLK}$. This lead is electrically connected to a hot terminal $T_H$ of the power source and thus the voltage applied to lamp holder $H1_A$ never exceeds the supply voltage $V_{AC}$.

End 4 of the primary sub winding $P1_B$ is electrically connected to a lead $W_{WH}$. This lead is electrically connected to a neutral terminal $T_N$ of the power source and thus the voltage applied to end 4 always remains at or near ground potential.

End 6 of the secondary winding S1 is electrically connected to the electrode $E2_B$ at the opposite end of the series combination, via lamp holder $H2_B$.

Note that, as indicated by the dot symbols, secondary winding S1 and the primary sub windings $P1_A$ and $P1_B$ are wound and connected such that the voltages across the series combination of windings $P1_A$ and S1 are additive, but the voltages across the series combination of windings S1 and $P1_B$ are subtractive. Thus, the voltage across primary sub winding $P1_A$ and a stepped up voltage across secondary winding S1 add, resulting in an open circuit voltage across the series lamp combination sufficient to ensure starting under worst case conditions (e.g. operation at low ambient temperatures). However, the voltages across secondary winding S1 and primary sub winding $P1_B$ subtract, resulting in a voltage at lamp holder $H2_B$ (referenced to ground) which is necessarily smaller than the voltage across the series lamp combination.

Figure 2:
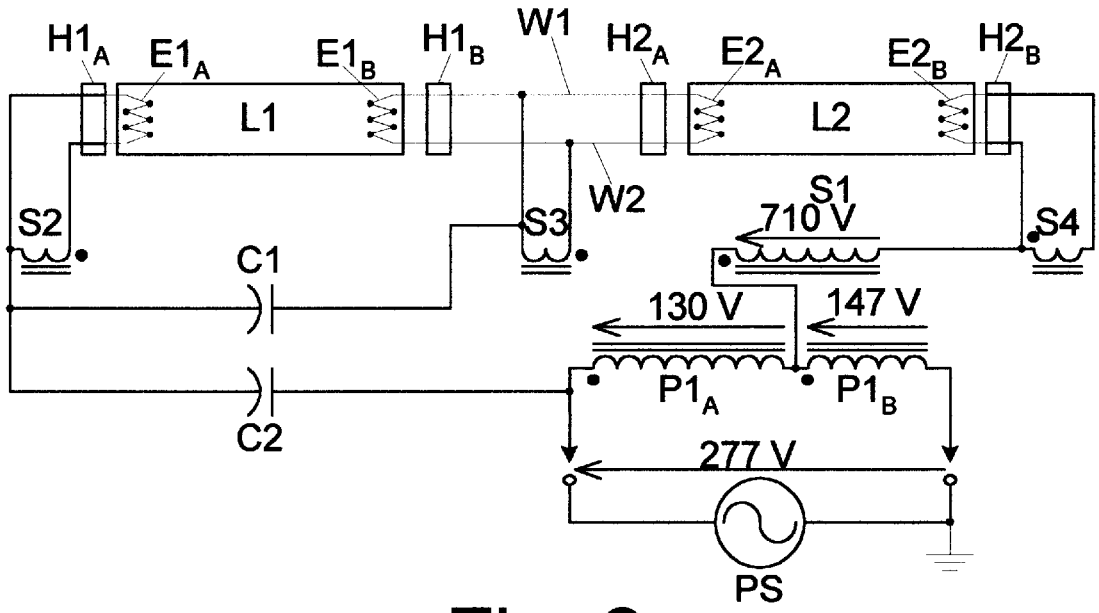
FIG. 2 illustrates operating parameters of a specific ballast of the type shown in FIG. 1.

The actual voltages developed across the transformer windings and applied to the lamp holders are determined by the magnitude of the source voltage $V_{AC}$ and the relative numbers of turns in the windings. FIG. 2 indicates these voltages in an actual circuit, which has been built and tested, for starting and operating two serially connected, 86 watt, high output fluorescent lamps, requiring an open circuit AC voltage of approximately 820 volts to start and operate the lamps at an ambient temperature of −20° F. (Note that all voltage values are RMS.) However, the highest rated lamp holder voltage was only 600 volts. The available power source was an AC power line having a voltage of 277 volts. Note that the open circuit voltage applied across the serial lamp combination was 840 volts, but the highest magnitude voltage (relative to ground) at any lamp holder was a voltage of 710−147=563 volts at lamp holder $H2_B$. The voltage at lamp holder H1A was 130+147=277 volts.

Figure 3:
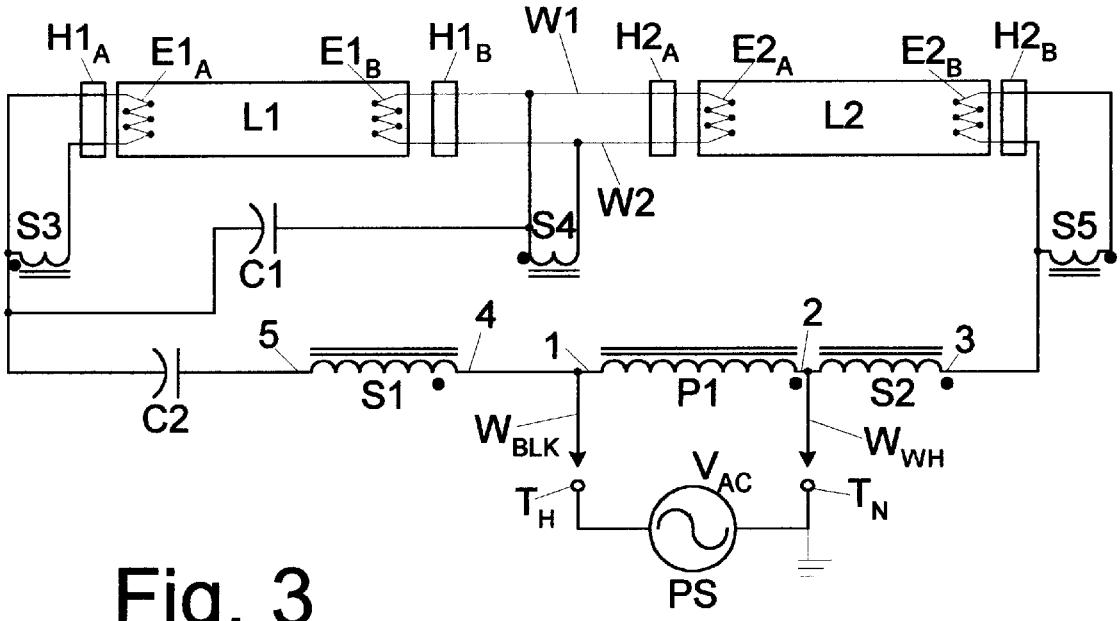
FIG. 3 is a schematic illustration of a second embodiment of an electromagnetic ballast for powering serially connected fluorescent lamps.

FIG. 3 schematically illustrates a second exemplary embodiment of an electromagnetic ballast in accordance with the invention. This embodiment is similar to that of FIGS. 1 and 2, but is particularly useful with lower supply voltages, e.g. 120 volts. The secondary winding is subdivided into two sections S1 and S2 connected at either end of a primary winding P1 and the secondary windings for heating the filaments are now designated S3, S4 and S5. Windings P1, S1 and S2 are all connected in series.

Note that, as indicated by the dot symbols, all three windings are wound and connected such that the voltages across them are additive. The resulting voltage across the lamps is sufficient to start them under worst case conditions. However, the voltages at each of the lamp holders $H1_A$ and $H2_B$ are well below the open-circuit starting voltage applied across the lamps. This results because the voltage at lamp holder $H1_A$ is referenced to ground through the windings S1 and P1, while the voltage at lamp holder $H2_B$ is referenced to ground through the winding S2.

Figure 4:
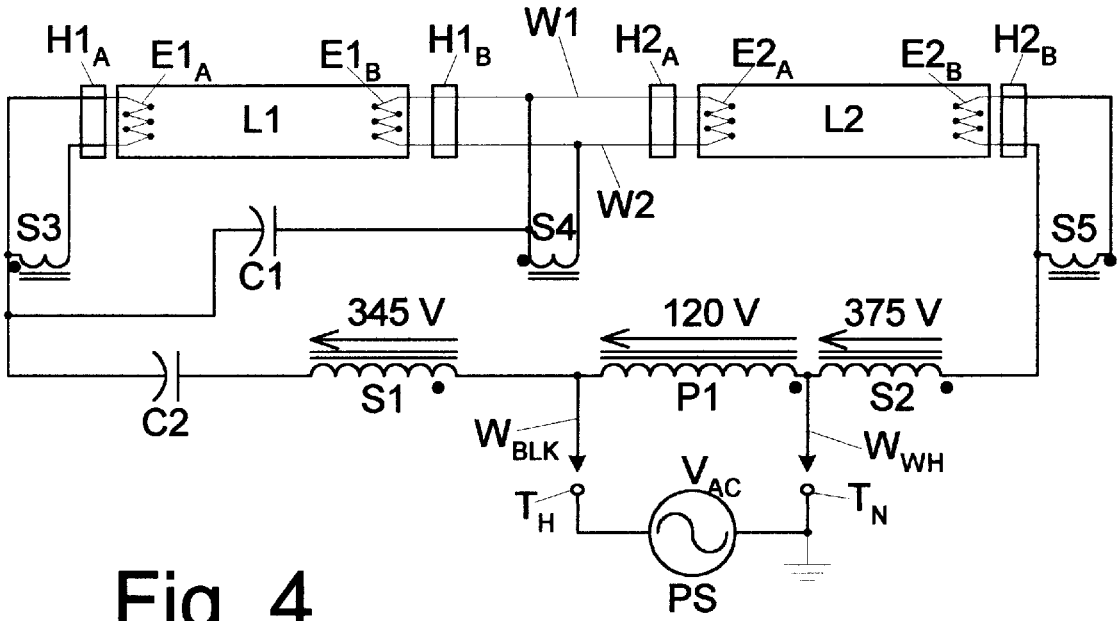
FIG. 4 illustrates operating parameters of a specific ballast of the type shown in FIG. 3.

FIG. 4 illustrates the voltages in an actual circuit, which has been built and tested, for starting and operating the same two serially connected, 86 watt, high output fluorescent lamps as in the embodiment of FIG. 2. However, in this case, the supply voltage $V_{AC}$ is only 120 volts. This ballast still provides a starting voltage of 840 volts, but the highest magnitude voltage (relative to ground) at any of the lamp holders was a voltage of 345+120=465 volts at lamp holder $H1_A$. The voltage at lamp holder $H2_B$ was 375 volts.

What is claimed is:

1. An electromagnetic ballast for starting and operating a plurality of gaseous discharge lamps which are serially connected between a first lamp holder connection and a second lamp holder connection, said ballast comprising a transformer including:

a. a primary winding for electrical connection to an AC power source, said primary winding including:

i) a first sub winding having a first end for electrical connection to the first lamp holder connection and to the AC power source and having a second end;

ii) a second sub winding having a first end electrically connected to the second end of the first sub winding and having a second end for electrical connection to the AC power source;

b. a secondary winding having:

i) a first end electrically connected to the second end of the first sub winding and to the first end of the second sub winding; and ii) a second end electrically connected to the second lamp holder connection;

said windings being wound such that, in operation, voltages produced by the first sub winding and the secondary winding are additive, but voltages produced by the second sub winding and the secondary winding are subtractive, whereby the voltage at each of the lamp connections is substantially lower than the voltage across the serially connected lamps.

2. An electromagnetic ballast as in claim 1 where, in operation, one of the first and second ends of the primary winding is electrically connected to approximately ground potential.

3. An electromagnetic ballast as in claim 1 where the second end of the second sub winding of the primary winding is electrically connected to approximately ground potential.

4. An electromagnetic ballast as claimed in claim 3 wherein the turns of the windings are chosen so that the subtractive voltage developed across the second subwinding and the secondary winding is below the rated voltage of the second lamp holder connection.

5. An electromagnetic ballast as in claim 1 where the first end of the first sub winding is electrically connected to one of the first and second lamps via a capacitor.

6. An electromagnetic ballast as in claim 1 where a capacitor is electrically connected across one of the first and second lamps as a shunt for facilitating starting of the other one of said lamps.

7. An electromagnetic ballast as claimed in claim 1 wherein the turns of the windings are chosen so that the subtractive voltage developed across the second subwinding and the secondary winding is below the rated voltage of the second lamp holder connection.

8. An electromagnetic ballast as claimed in claim 1 wherein the turns of the first and second subwindings of the primary winding are chosen so that approximately the same magnitude of voltage is developed across the first and second subwindings.

9. An electromagnetic ballast as claimed in claim 8 wherein the primary winding is adapted to be connected to an AC source of supply voltage of at least 277 volts.

10. An electromagnetic ballast for starting and operating a plurality of gaseous discharge lamps which are serially connected between a first lamp holder connection and a second lamp holder connection, said ballast comprising a transformer including:

a. a primary winding for electrical connection to an AC power source, said primary winding including first and second ends for electrical connection to the AC power source;

b. a first secondary winding having a first end electrically connected to the first lamp holder connection and having a second end electrically connected to the first end of the primary winding;

c. a second secondary winding having a first end electrically connected to the second end of the primary winding and having a second end electrically connected to the second lamp holder connection;

said windings being wound and connected such that, in operation, voltages produced by the windings are additive and said second end of the primary winding is electrically connected to approximately ground potential, whereby the voltage at each of the lamp connections is substantially lower than the voltage across the serially connected lamps.

11. An electromagnetic ballast as in claim 10 where one end of one of the first and second secondary windings is electrically connected to one of the first and second lamps via a capacitor.

12. An electromagnetic ballast as in claim 10 where a capacitor is electrically connected across one of the first and second lamps as a shunt for facilitating starting of the other one of said lamps.

* * * * *